US011760104B2

(12) United States Patent
Takano et al.

(10) Patent No.: US 11,760,104 B2
(45) Date of Patent: Sep. 19, 2023

(54) LIQUID DISCHARGE APPARATUS, AND LIQUID DISCHARGE METHOD

(71) Applicants: Nanami Takano, Tokyo (JP); Toshiya Satoh, Kanagawa (JP); Teiichiro Ishikawa, Tokyo (JP); Yohsuke Konishi, Kanagawa (JP)

(72) Inventors: Nanami Takano, Tokyo (JP); Toshiya Satoh, Kanagawa (JP); Teiichiro Ishikawa, Tokyo (JP); Yohsuke Konishi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/732,518

(22) Filed: Apr. 29, 2022

(65) Prior Publication Data

US 2022/0371330 A1 Nov. 24, 2022

(30) Foreign Application Priority Data

May 18, 2021 (JP) ..... 2021-084217

(51) Int. Cl.
*B41J 2/175* (2006.01)
*B41J 2/045* (2006.01)
*B41J 2/14* (2006.01)

(52) U.S. Cl.
CPC ..... *B41J 2/17596* (2013.01); *B41J 2/04581* (2013.01); *B41J 2/14201* (2013.01); *B41J 2202/12* (2013.01)

(58) Field of Classification Search
CPC ..... B41J 2/17596; B41J 2/19; B41J 2/14201; B41J 2/04581; B41J 2/18; B41J 2/175; B41J 2/195; B41J 2/14274; B41J 2202/12
See application file for complete search history.

(56) References Cited

U.S. PATENT DOCUMENTS

| | | | | |
|---|---|---|---|---|
| 9,333,754 | B2 * | 5/2016 | Ishii | B41J 29/38 |
| 10,576,749 | B2 * | 3/2020 | Moriwaki | B41J 2/14274 |
| 10,792,930 | B2 * | 10/2020 | Yamada | B41J 2/14024 |
| 2018/0041664 | A1 | 2/2018 | Konishi et al. | |
| 2018/0134033 | A1 | 5/2018 | Sawase | |
| 2020/0276839 | A1 | 9/2020 | Satoh et al. | |

FOREIGN PATENT DOCUMENTS

| | | |
|---|---|---|
| JP | 6-218945 | 8/1994 |
| JP | 2017-124561 | 7/2017 |
| JP | 2017-200742 | 11/2017 |

(Continued)

*Primary Examiner* — An H Do
(74) *Attorney, Agent, or Firm* — XSENSUS LLP

(57) ABSTRACT

A liquid discharge apparatus includes a head including a supply path and a discharge path circulating a liquid in a liquid circulation direction, the head configured to discharge the liquid, a circulation path coupled to the head, the liquid circulates through the head in the circulation path, a bypass coupled to a downstream end of the supply path of the head and an upstream end of the discharge path of the head in the liquid circulation direction, a pressure generator configured to generate and apply a circulation pressure to the liquid circulating through the circulation path, and a deaerator configured to remove gas in the liquid circulating the circulation path.

7 Claims, 12 Drawing Sheets

(56) References Cited

FOREIGN PATENT DOCUMENTS

| | | |
|---|---|---|
| JP | 2018-024239 | 2/2018 |
| JP | 2018-083413 | 5/2018 |
| JP | 2018-202768 | 12/2018 |
| JP | 2019-059047 | 4/2019 |
| JP | 2020-044726 | 3/2020 |
| JP | 2020-082483 | 6/2020 |
| JP | 2020-082635 | 6/2020 |
| JP | 2020-143891 | 9/2020 |
| JP | 2020-203393 | 12/2020 |

* cited by examiner

LIQUID DISCHARGE APPARATUS, AND LIQUID DISCHARGE METHOD

CROSS-REFERENCE TO RELATED APPLICATIONS

This patent application is based on and claims priority pursuant to 35 U.S.C. § 119(a) to Japanese Patent Application No. 2021-084217, filed on May 18, 2021, in the Japan Patent Office, the entire disclosure of which is incorporated by reference herein.

BACKGROUND

Technical Field

Embodiments of the present disclosure relate to a liquid discharge apparatus and a liquid discharge method.

Related Art

A liquid supply apparatus for supplying a liquid to a liquid discharger of a liquid discharge apparatus has a configuration having a circulation path for circulating the supplied liquid. When a bubble is contained in a liquid supplied by such a liquid supply apparatus, poor discharge, such as discharge failure and curved discharge, may occur in the liquid discharger to which the liquid is supplied.

Further, in a configuration having a circulation path, an ink injection pressure or ink discharge pressure is controlled, a meniscus formed by ink staying in a nozzle is destroyed, and the ink is moved inward from the periphery of a discharge side outlet of the nozzle, or the ink is moved inward from the nozzle. Consequently, the ink staying in the nozzle is replaced with new ink without wasting the staying ink.

SUMMARY

In an aspect of this disclosure, a liquid discharge apparatus includes a head including a supply path and a discharge path circulating a liquid in a liquid circulation direction, the head configured to discharge the liquid, a circulation path coupled to the head, the liquid circulates through the head in the circulation path, a bypass coupled to a downstream end of the supply path of the head and an upstream end of the discharge path of the head in the liquid circulation direction, a pressure generator configured to generate and apply a circulation pressure to the liquid circulating through the circulation path, a deaerator configured to remove gas in the liquid circulating the circulation path, a switch configured to alternately switchable the circulation path between a first path and a second path, the first path including the bypass as a part of the circulation path, and a second path not including the bypass in the circulation path, a detector configured to detect a bubble in the liquid circulating through the circulation path, and circuitry configured to control the switch to switch the circulation path to the first path in response to a detection of the bubble by the detector.

In another aspect of this disclosure, a liquid discharge method includes discharging a liquid from a head, circulating the liquid through the head in a circulation path in a liquid circulation direction, coupling a bypass to a downstream end of a supply path of the head and an upstream end of a discharge path of the head in the liquid circulation direction, generating and applying a circulation pressure to the liquid circulating through the circulation path, removing gas in the liquid circulating the circulation path, alternately switching the circulation path between a first path and a second path, the first path including the bypass as a part of the circulation path, and a second path not including the bypass in the circulation path, detecting a bubble in the liquid circulating through the circulation path, and switching the circulation path to the first path in response to a detection of the bubble by the detector.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
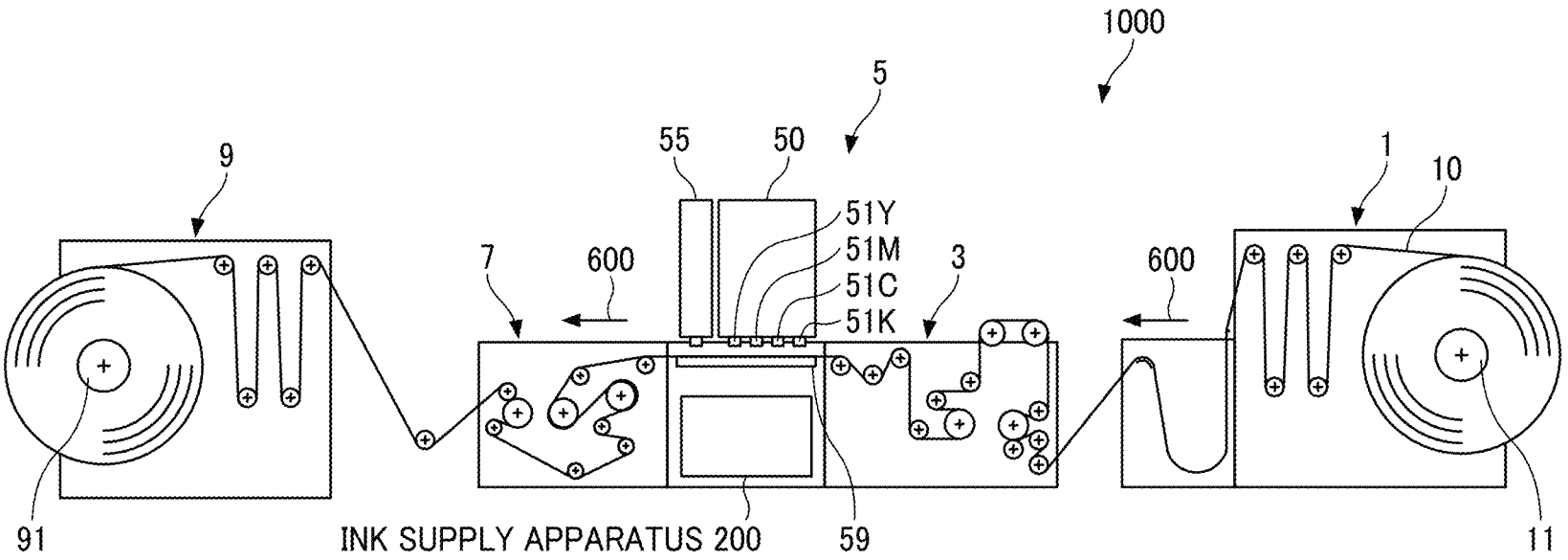
FIG. 1 is a diagram illustrating an example of the general arrangement of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION OF EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of the present disclosure are described in detail with reference to the drawings. In the drawings, like reference signs denote like elements, and redundant description may be omitted where appropriate.

The embodiments described below are some examples of a liquid supply apparatus and a liquid discharge apparatus for embodying the technical idea of the present disclosure. Embodiments of the present disclosure are not limited to the embodiments described below. For example, the sizes, materials, and shapes of components, and the relative positions of the arranged components are given by way of example in the following description. The scope of the present disclosure is not limited thereto unless particularly specified. The sizes, positional relationships, and the like of members illustrated in the drawings may be magnified for clarity of the description.

Embodiments of an image forming apparatus are described as examples of a liquid discharge apparatus in the following description. The image forming apparatus includes a liquid supply apparatus, and a liquid discharger that discharges liquid supplied from the liquid supply apparatus. The image forming apparatus uses a liquid discharge method as an ink jet method that discharges liquid from the liquid discharger to form an image on a recording medium. Note that image formation, recording, printing, printing, and printing in the terms of the embodiments are synonymous.

Further, the term "liquid" includes any liquid having a viscosity or a surface tension that can be discharged from a liquid discharger.

The "liquid" is not limited to a particular liquid and may be any liquid having a viscosity or a surface tension to be discharged from a liquid discharger.

However, preferably, the viscosity of the liquid is not greater than 30 mPa·s under ordinary temperatures and ordinary pressures, or when heated or cooled.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as deoxyribonucleic acid (DNA), amino acid, protein, or calcium, or an edible material, such as a natural colorant. For example, these can be used for inkjet ink or the like.

The liquid discharger is a functional component that discharges and jets liquid from a nozzle. Examples of an energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a vibration plate and opposed electrodes.

Example of General Arrangement of Image Forming Apparatus 1000

FIG. 1 is a diagram illustrating an example of the general arrangement of an image forming apparatus 1000 according to an embodiment of the present disclosure.

Figure 2:
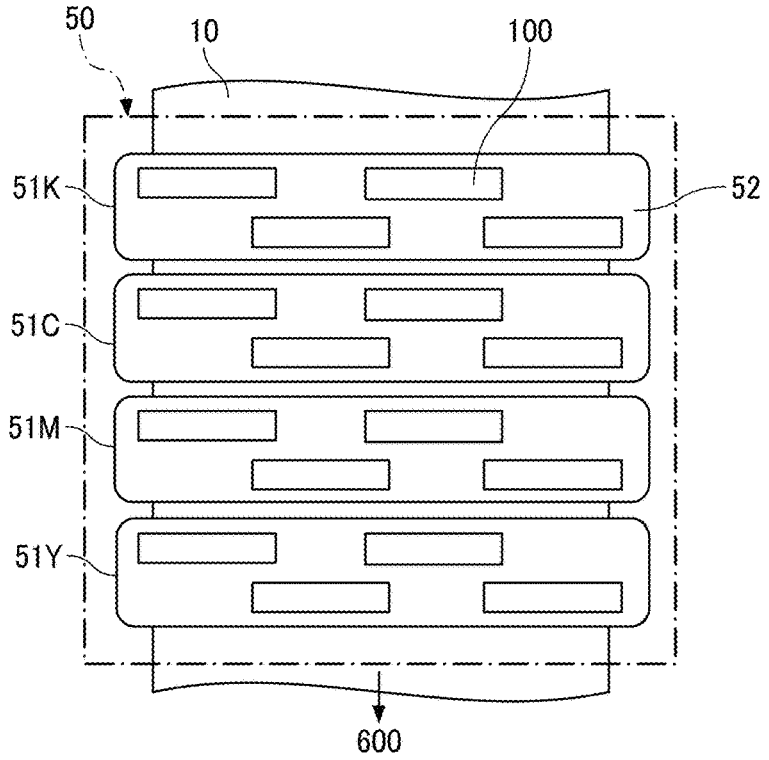
FIG. 2 is a plan view illustrating an example of the configuration of a head unit.

FIG. 1 illustrates the image forming apparatus 1000 seen through from the side. FIG. 2 is a plan view illustrating an example of the configuration of a head unit 50 of the image forming apparatus 1000.

The image forming apparatus 1000 is one of an example of the liquid discharge apparatus.

As illustrated in FIG. 1, the image forming apparatus 1000 includes a conveying-in device 1, a guiding and conveying device 3, an image forming device 5, a dryer 7, and an ejection device 9.

A rolled sheet 10 is a long continuous sheet. The rolled sheet 10 is an example of a recording medium. The conveying-in device 1 feeds out the rolled sheet 10 from an original wound roller 11. Each of the conveying-in device 1, the guiding and conveying device 3, the dryer 7, and the ejection device 9 guides and conveys the rolled sheet 10 with conveyance rollers provided in the conveying-in device 1, the guiding and conveying device 3, the dryer 7, and the ejection device 9. The ejection device 9 rewinds the rolled sheet 10 that has been conveyed, around a rewound roller 91.

The image forming device 5 forms an image on the rolled sheet 10 with inks (examples of the liquid) discharged from the head unit 50, and performs aftertreatment with a treatment liquid discharged from a head unit 55 while the image forming device 5 conveys the rolled sheet 10 along a conveyance direction 600 while the rolled sheet 10 faces the head unit 50 and the head unit 55.

The image forming device 5 also includes a liquid supply apparatus 200. The liquid supply apparatus 200 is an example of the liquid supply apparatus that supplies inks to liquid discharge heads 100 included by the head unit 50.

Hereinafter, the liquid discharge head 100 is simply referred to as a "head 100". The head 100 is an example of the liquid discharger.

In the head unit 50, for example, full-line head arrays 51K, 51C, 51M, and 51Y for four colors are arranged from the upstream side in a medium conveyance direction. Hereinafter, the head arrays 51K, 51C, 51M, and 51Y are collectively referred to as head arrays 51 unless the colors are not distinguished.

The head arrays 51K, 51C, 51M, and 51Y discharge inks of black K, cyan C, magenta M, and yellow Y, respectively, onto the rolled sheet 10 being conveyed along a p. However, the types and the number of inks are not limited to black K, cyan C, magenta M, and yellow Y, but may be appropriately modified according to the use of the image forming apparatus 1000, or the like.

As illustrated in FIG. 2, for example, each of the head arrays 51 includes the plurality of ink discharge heads 100 arranged on a base member 52 in a staggered manner. However, the number, arrangement, and the like of the ink discharge heads 100 are not limited to the number, arrangement, and the like illustrated in FIG. 2, but may be appropriately modified according to the use of the image forming apparatus 1000, or the like.

Example of Configuration of Head 100

Figure 3:
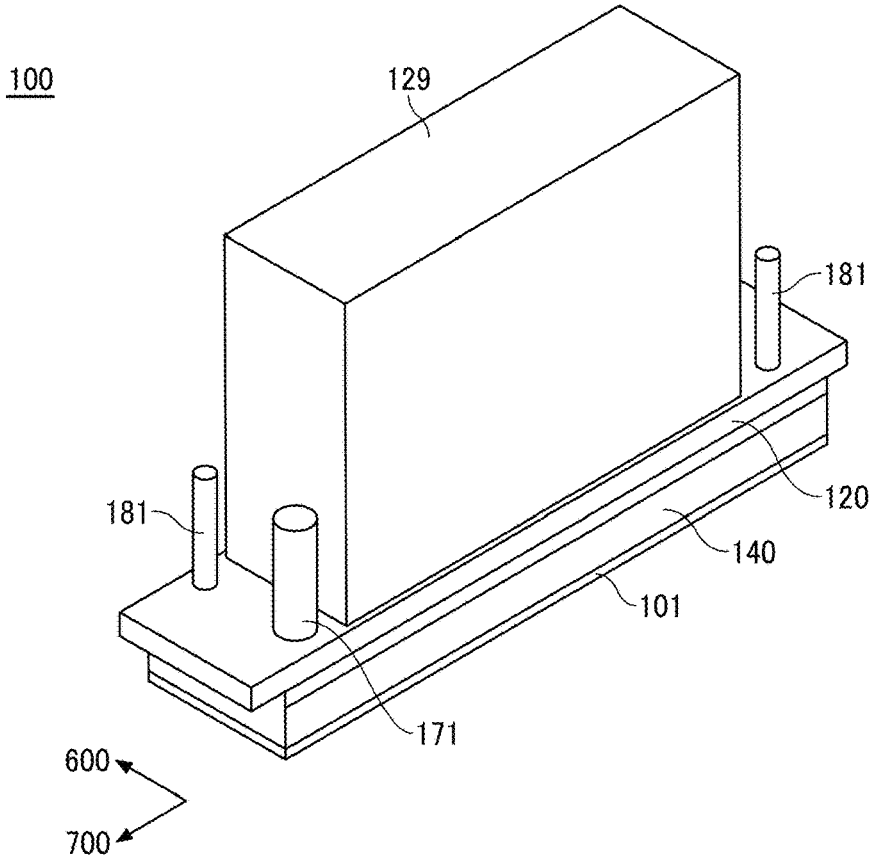
FIG. 3 is a perspective view illustrating an example of the configuration of a liquid discharge head according to an embodiment of the present disclosure.
Figure 4:
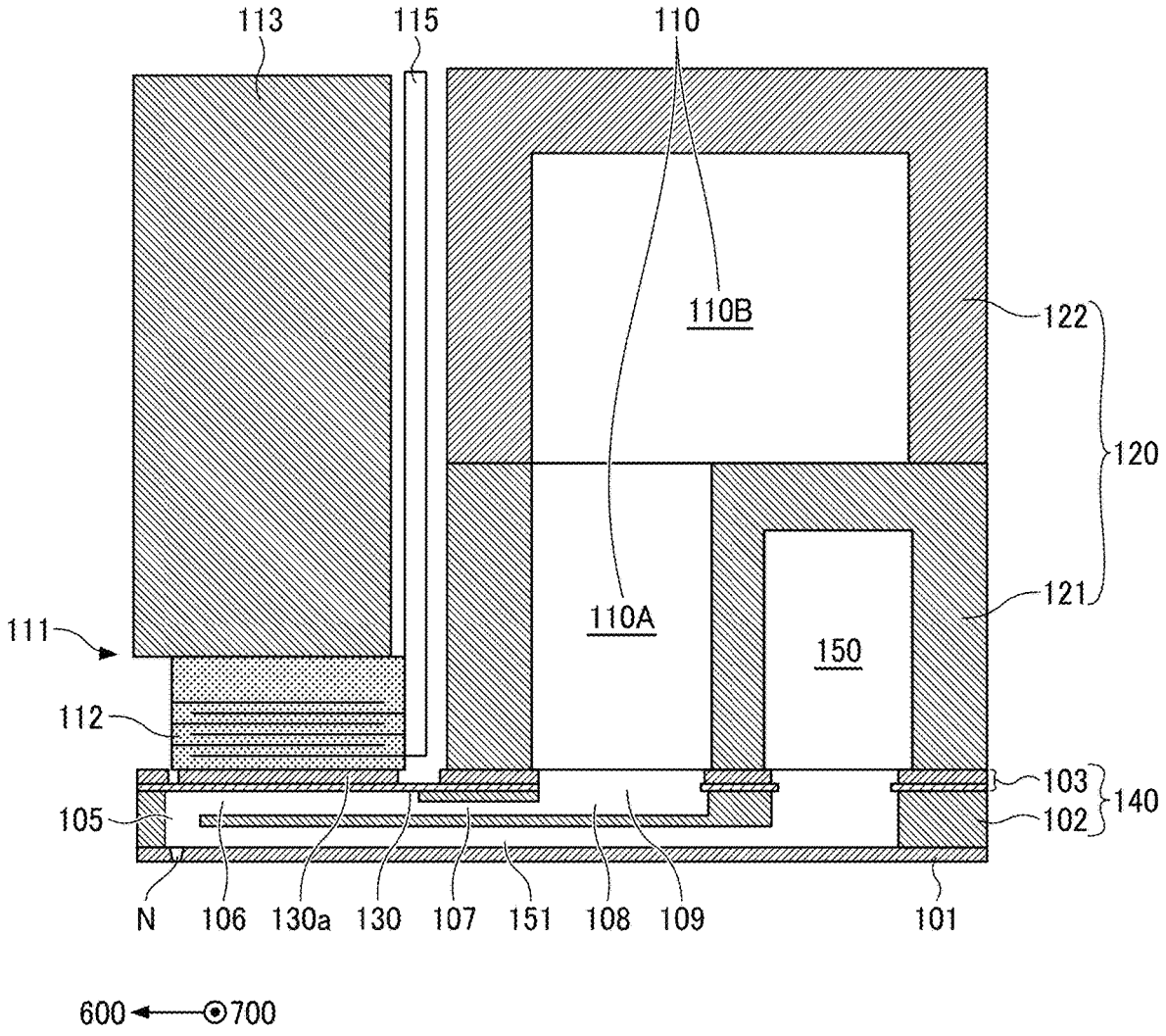
FIG. 4 is a cross-sectional view of the liquid discharge head taken along a plane including a conveyance direction.

Next, the configuration of the head 100 will be described with reference to FIGS. 3 and 4. FIG. 3 is a perspective view illustrating an example of the outside of the head 100. FIG. 4 is a cross-sectional view of the head 100 taken along a plane including the conveyance direction 600. However, the cross section of the head 100 taken along a plane including the conveyance direction 600 includes the configuration in FIG. 4 and the configuration in FIG. 4 that is mirror-reversed.

The head 100 includes a nozzle plate 101, a channel plate 102, and a vibration plate member 103 as a wall member. The nozzle plate 101, the channel plate 102, and the vibration plate member 103 are laminated together and bonded to each other. The head 100 also includes a piezoelectric actuator 111, a common-chamber member 120, and a cover 129. The piezoelectric actuator 111 displaces a vibration area (vibration plate) 130 of the vibration plate member 103. The common-chamber member 120 also serves as a frame of the head 100. A portion of the head 100 that includes the channel plate 102 and the vibration plate member 103 is referred to as a channel member 140.

The nozzle plate 101 includes a plurality of nozzles N that discharges an ink. The plurality of nozzles N is arranged along a nozzle arrangement direction 700.

The channel plate 102 includes individual chambers (pressure chambers) 106, supply-side fluid resistances 107, and through holes or grooves as supply-side inlets 108. The individual chambers (pressure chambers) 106 communicate with the nozzles N via nozzle communication channels 105, respectively. The supply-side fluid resistances 107 communicate with the individual chambers (pressure chambers) 106, respectively. The supply-side inlets 108 communicate with the supply-side fluid resistances 107, respectively. The nozzle communication channel 105 is a channel continuous and communicating with the nozzle N and the individual chamber 106. The supply-side inlets 108 communicate with a supply-side common chamber 110 through supply-side openings 109 of the vibration plate member 103.

The vibration plate member 103 includes the vibration area 130. The vibration area 130 is deformable and serves as a wall of the individual chambers 106 of the channel plate 102. The vibration plate member 103 has a two-layer structure (but is not limited to the two-layer structure). The vibration plate member 103 includes a first layer and a second layer in this order from a side facing the channel plate 102. The first layer forms a thin portion. The second layer forms a thick portion. The first layer forms the vibration area 130 that is deformable, at a portion corresponding to the individual chambers 106.

The piezoelectric actuator 111 is disposed on a side of the vibration plate member 103 opposite a side of the vibration plate member 103 facing the individual chambers 106. The piezoelectric actuator 111 includes an electromechanical transducer serving as a driving device (an actuator device or a device) to deform the vibration area 130 of the vibration plate member 103.

The piezoelectric actuator 111 includes piezoelectric members 112 bonded onto the base member 113. The piezoelectric members 112 are grooved by half-cut dicing so that each of the piezoelectric members 112 includes the desired number of piezoelectric elements 112. The piezoelectric elements 112 have a pillar-like shape, and are arranged at predetermined intervals like a comb.

The piezoelectric element 112 is bonded to a projection portion 130*a*. The projection portion 130*a* is an island-shaped thick portion on the vibration area 130 of the vibration plate member 103. The piezoelectric element 112A is coupled to a flexible wiring member 115.

The common-chamber member 120 includes the supply-side common chamber 110 and a discharge-side common chamber 150. The supply-side common chamber 110 communicates with a supply port 171. The discharge-side common chamber 150 communicates with a discharge port 181.

The common-chamber member 120 includes a first common-chamber member 121 and a second common-chamber member 122. The first common-chamber member 121 is bonded to the vibration plate member 103 side of the channel member 140. The second common-chamber member 122 is stacked on and bonded to the first common-chamber member 121.

The first common-chamber member 121 includes a downstream-side common chamber 110A and the discharge-side common chamber 150. The downstream-side common chamber 110A is part of the supply-side common chamber 110 that communicates with the supply-side inlets 108. The discharge-side common chamber 150 communicates with discharge channels 151. The second common-chamber member 122 includes an upstream-side common chamber 110B that is the remaining part of the supply-side common chamber 110.

The channel plate 102 includes the discharge channels 151. The discharge channels 151 are formed along a surface direction of the channel plate 102, and communicate with the individual chambers 106 via the nozzle communication channels 105, respectively. The discharge channels 151 as individual circulation channels communicate with the discharge-side common chamber 150.

In the head 100, for example, when the voltage applied to the piezoelectric element 112A is lowered from a reference potential (intermediate potential), the piezoelectric element 112A contracts. As a result, the vibration area 130 of the vibration plate member 103 is pulled and the volumes of the individual chambers 106 expand. Consequently, the ink flows into the individual chambers 106.

The voltage applied to the piezoelectric element 112A is thereafter raised to expand the piezoelectric element 112A in the lamination direction. Thus, the vibration area 130 of the vibration plate member 103 is deformed toward the nozzle N, and the volume of the individual chamber 106 is contracted. As a result, the ink in the individual chamber 106 is pressurized and discharged from the nozzle N.

The ink not discharged from the nozzles N passes through the nozzles N, is discharged from the discharge channels 151 to the discharge-side common chamber 150, and is supplied to the supply-side common chamber 110 from the discharge-side common chamber 150 again through an external circulation path.

A method for driving the head 100 is not limited to the above-described method (i.e., pull-push discharging). A way of discharging changes depending on how a drive waveform is applied to the piezoelectric element 112A. For example, pull discharging or push discharging is possible.

Example of Configuration of Liquid Supply Apparatus 200

General Arrangement

Figure 5:
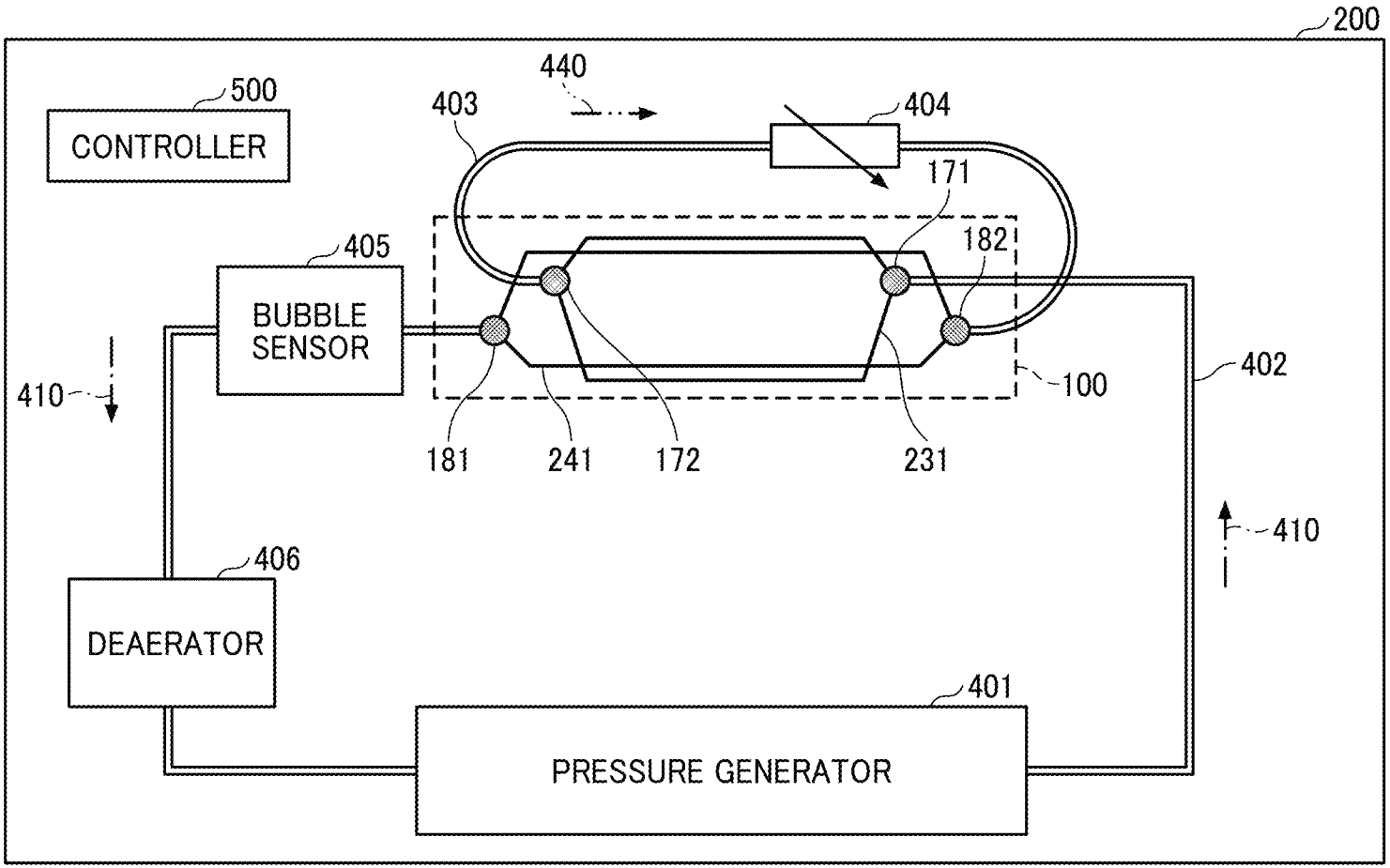
FIG. 5 is a block diagram illustrating an example of the general arrangement of a liquid supply apparatus according to a first embodiment of the present disclosure.

FIG. 5 is a block diagram illustrating an example of the general arrangement of the liquid supply apparatus 200.

Figure 6:
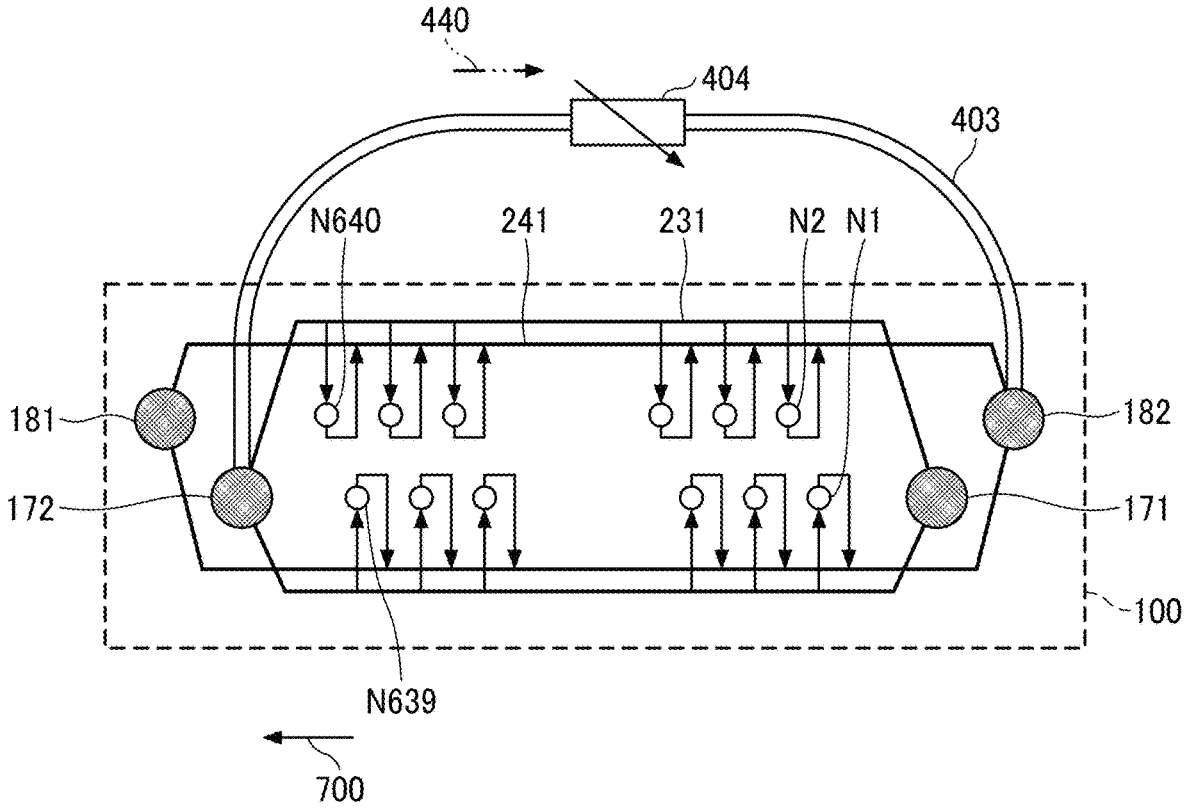
FIG. 6 is a diagram illustrating movement of ink in the liquid discharge head according to the first embodiment.

FIG. 6 is a diagram illustrating movement of ink in the head 100 provided in a circulation path 402 of the liquid supply apparatus 200.

As illustrated in FIG. 5, the liquid supply apparatus 200 includes a pressure generator 401, the circulation path 402, a bypass 403, a variable resistance 404, a bubble sensor 405, a deaerator 406, and a controller 500.

When the bubble sensor 405 detects a bubble in ink that circulates through the circulation path 402, the liquid supply apparatus 200 performs control with the controller 500 to allow the ink to flow through a first path that includes the bypass 403 as part of the circulation path 402. Since the ink flows through the bypass 403, the ability to discharge a bubble in ink is improved compared with a second path that does not include the bypass 403 in the circulation path 402. Consequently, the liquid supply apparatus 200 efficiently removes a bubble in the ink without varying a pressure applied to the ink. The discharge ability means the easiness of discharge.

The pressure generator 401 is provided in the circulation path 402. The pressure generator 401 generates a circulation pressure to circulate ink through the circulation path 402. The configuration of the pressure generator 401 will be further described in detail with reference to FIG. 7.

The circulation path 402 includes a channel, such as an ink tube, through which ink flows. The circulation path 402 is a path through which ink circulates through the liquid supply apparatus 200. The circulation pressure generated by the pressure generator 401 feeds ink through the channel along a liquid circulation direction 410, and circulates the ink through the circulation path 402.

The head 100 is provided in part of the circulation path 402. As illustrated in FIGS. 5 and 6, the head 100 includes nozzles (N1 to N640), a supply path 231, a discharge path 241, a supply port 171, a bypass inlet port 172, a discharge port 181, and a bypass outlet port 182. The head 100 may be an element of the liquid supply apparatus 200 but is not an essential element of the liquid supply apparatus 200.

The supply path 231 of the head 100 is disposed upstream of the nozzle N and is a path that supplies the liquid from the supply port 171 to the nozzle N. The supply path 231 includes the upstream-side common chamber 110B, the downstream-side common chamber 110A, the nozzle communication channel 105, the individual chamber 106 (pressure chambers), the supply-side fluid resistance 107, the supply-side inlet 108, and through supply-side opening 109.

The discharge path 241 of the head 100 is disposed downstream of the nozzle N and is a path that collects and discharge the liquid that is not discharged from the nozzle N to the discharge port 181. The discharge path 241 includes the discharge channels 151 and the discharge-side common chamber 150.

The bypass 403 includes a channel, such as an ink tube. The bypass 403 is a path coupled to (provided on) the upstream side and the downstream side of the head 100 in the liquid circulation direction 410. The bypass inlet port 172 of the bypass 403 is coupled to (provided on) a downstream end part of the supply path 231 of the head 100 in the liquid circulation direction 410. The bypass outlet port 182 of the bypass 403 is coupled to (provided on) an upstream end part of the discharge path 241 of the head 100 in the liquid circulation direction 410.

With the first path, ink that circulates through the circulation path 402 flows into the head 100 through the supply port 171. Part of the ink that has flowed into the head 100 passes through each of the supply-side common chamber 110 and the individual chamber 106 (pressure chamber) in the head 100, and then flows into the bypass 403 through the bypass inlet port 172. The ink that has flowed into the bypass 403, is fed through the bypass 403 along a bypass direction 440, flows out of the bypass 403 through the bypass outlet port 182, and then flows into the head 100 again.

Then part of the ink not discharged from the nozzles N is collected from each of the plurality of individual chambers 106 in the head 100, and the ink collected from each of the individual chambers 106 and the discharge channels 151 reaches the discharge port 181. The ink is discharged outside the head 100 from the discharge port 181 through the discharge path 241.

On the other hand, with the first path, another part of the ink supplied to the head 100 reaches the discharge port 181 through each of the plurality of individual chambers 106 of the supply path 231 provided in the head 100 and the discharge path 241 without passing through the bypass 403, and is discharged from the head 100 through the discharge port 181.

With the second path, ink supplied to the head 100, reaches the discharge port 181 through each of the plurality of individual chambers 106 of the supply path 231 provided in the head 100 and the discharge path 241 without passing through the bypass 403, and is discharged from the head 100 through the discharge port 181.

As illustrated in FIG. 6, the head 100 includes 640 numbers of nozzles N (N1 to N640). The 640 numbers of nozzles N1 to N640 are arranged in two rows along the nozzle arrangement direction 700. The nozzles N1 to N640 are paired with 640 individual chambers 106. Ink passes through each of the individual chambers 106, and thus the ink is supplied to each of the individual chambers 106. Consequently, each of the nozzles N is into a state of being able to discharge the ink.

Each of the individual chambers 106 communicates with the discharge path 241. Ink supplied to each of the individual chambers 106 is discharged through the discharge path 241. In this way, ink circulates while being repeatedly supplied and discharged to and from each of the individual chambers 106. Consequently, the ink is kept fresh in the individual chambers 106.

The variable resistance 404 is changeable a fluid resistance in the bypass 403. The variable resistance 404 is an example of a switch that alternately switches between the first path that includes the bypass 403 as part of the circulation path 402, and the second path that does not include the bypass 403 in the circulation path 402. However, the switch is not limited to the variable resistance 404, but may include a solenoid valve that switches between ink channels, or the like.

According to the present embodiment, the variable resistance 404 includes a solenoid valve 41 provided in the bypass 403, and a motor that drives the solenoid valve 41.

The variable resistance 404 drives the solenoid valve 41 to vary the fluid resistance to ink that flows through the solenoid valve 41. The variable resistance 404 decreases the fluid resistance to allow the ink to flow through the bypass 403 to switch to the second path. The variable resistance 404 increases the fluid resistance not to allow the ink to flow through the bypass 403 to switch to the first path. The configuration of the solenoid valve 41 will be further described in detail with reference to FIG. 8.

The bubble sensor 405 is an example of a detector that detects a bubble in ink fed through the circulation path 402. The bubble sensor 405 is provided downstream from the head 100 in the liquid circulation direction 410, that is to say is provided to the negative pressure side of the head 100. The bubble sensor 405 accurately detects a bubble compared with the bubble sensor 405 provided on the positive pressure side.

The bubble sensor 405 is, for example, an ultrasonic sensor. The ultrasonic bubble sensor transmits ultrasonic waves into a channel of the circulation path 402 from a piezoelectric element on one side, receives the ultrasonic waves that have propagated through the channel with a piezoelectric element on the other side, and determines the reception strength of the ultrasonic waves.

Ink and a bubble differ in efficiency of propagation of ultrasonic waves. When a bubble exists in ink, the bubble blocks ultrasonic waves, and thus the reception strength decreases. Therefore, the bubble sensor 405 detects the existence and absence of a bubble on the basis of the determined reception strength. The bubble sensor 405 detects, for example, 0.3 μL or more of gas contained in ink, as a bubble. The bubble sensor 405 does not detect a bubble when ink does not contain 0.3 μL or more of gas.

The detector is not limited to an ultrasonic bubble sensor, but may be an optical bubble sensor. However, an ultrasonic bubble sensor may be preferable considering the ultrasonic bubble sensor is not affected by the transmittance of a channel.

The deaerator 406 is provided downstream from the bubble sensor 405 in the liquid circulation direction 410. The deaerator 406 removes gas in ink that circulates through the circulation path 402. A deaeration type of the deaerator 406 may be any one of a pressure decrease type that decreases the pressure to remove gas, a heating type that heats the ink to decrease the solubility of dissolved gas to remove the gas, a chemical type that reacts a chemical and dissolved gas to remove the gas, or the like.

The efficiency with which the deaerator 406 removes gas in the ink depends on the amount of the ink that flows through the circulation path 402. Therefore, when a bubble is detected in the ink that circulates through the circulation path 402, the liquid supply apparatus 200 allows the ink to flow through the bypass 403 to increase the amount of the ink that circulates through the circulation path 402. Consequently, the liquid supply apparatus 200 efficiently removes the bubble in the ink.

The controller 500 controls a switch operation by the variable resistance 404 that switches between the first path and the second path. The configuration of the controller 500 will be further described in detail with reference to FIGS. 9 and 10.

In FIG. 5, a configuration is exemplified in which the liquid supply apparatus 200 supplies ink to the one head 100. However, the example is not limiting, but the liquid supply apparatus 200 may supply ink to a plurality of the heads 100.

When the liquid supply apparatus 200 supplies ink to a plurality of the heads 100, the liquid supply apparatus 200 branches the ink that circulates through the circulation path 402 with a manifold or the like, into a plurality of paths that corresponds to the number of the heads 100. Consequently, the liquid supply apparatus 200 supplies the ink to each of the plurality of heads 100. The liquid supply apparatus 200 merges the ink discharged from each of the plurality of heads 100, into one flow with a manifold or the like to circulate the ink through the circulation path 402.

A path of ink according to the present embodiment is not limited to the circulation path 402, the supply path 231, the discharge path 241, and the like illustrated in FIG. 5. The path of ink may be appropriately modified according to the specifications of the liquid supply apparatus 200 when the ink can circulate, and each of the supply-side common chamber 110 and the discharge-side common chamber 150 of the head 100 can be filled with the ink.

[Pressure Generator 401]

Figure 7:
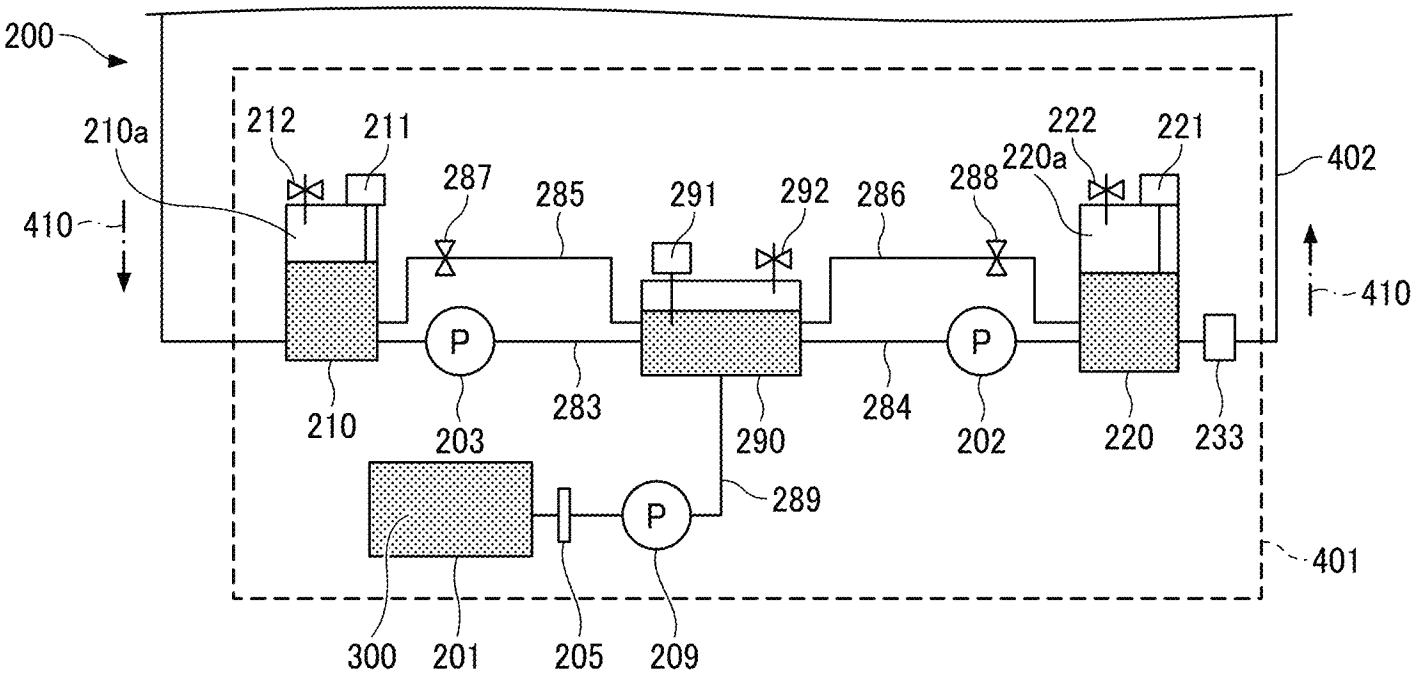
FIG. 7 is a block diagram of an example of the configuration of a pressure generator.

FIG. 7 is a block diagram illustrating an example of the configuration of the pressure generator 401. FIG. 7 illustrates only the surroundings around the pressure generator 401 in the liquid supply apparatus 200.

As illustrated in FIG. 7, the pressure generator 401 includes a main tank 201, a pressurized sub-tank 220, a depressurized sub-tank 210, an intermediate sub-tank 290, a first liquid feed pump 202, a second liquid feed pump 203, a third liquid feed pump 209, and a collection pressure sensor 233.

The pressure generator 401 generates a circulation pressure mainly with the pressurized sub-tank 220, the depressurized sub-tank 210, the first liquid feed pump 202, and the second liquid feed pump 203 to apply the circulation pressure to the ink that circulates through the circulation path 402. The pressure generator 401 controls the circulation pressure on the basis of detection results detected by the collection pressure sensor 233.

The main tank 201 stores ink to be discharged from the head 100. The intermediate sub-tank 290 is disposed between the pressurized sub-tank 220 and the depressurized sub-tank 210. The pressure generator 401 feeds and supplies the ink stored in the main tank 201, with the third liquid feed pump 209, to the intermediate sub-tank 290 via an ink path 289. The ink path 289 includes a filter 205.

The intermediate sub-tank 290 includes a liquid level detector 291 and a solenoid valve 292. The solenoid valve 292 constitutes a mechanism that opens the inside of the intermediate sub-tank 290 to the atmosphere.

The intermediate sub-tank 290 is coupled to the depressurized sub-tank 210 through an ink path 283. The ink path 283 includes the second liquid feed pump 203. The intermediate sub-tank 290 is also coupled to the depressurized sub-tank 210 through a reverse-flow ink path 285. The reverse-flow ink path 285 includes a solenoid valve 287.

The depressurized sub-tank 210 includes a gas chamber 210*a* in which ink and gas coexist. The depressurized sub-tank 210 includes a liquid level detector 211 and a solenoid valve 212. The liquid level detector 211 detects a liquid level in the depressurized sub-tank 210. The solenoid valve 212 serves as a mechanism that opens the inside of the depressurized sub-tank 210 to the atmosphere.

The intermediate sub-tank 290 is coupled to the pressurized sub-tank 220 through an ink path 284. The ink path 284 includes the first liquid feed pump 202. The intermediate sub-tank 290 is also coupled to the pressurized sub-tank 220 through a reverse-flow ink path 286. The reverse-flow ink path 286 includes a solenoid valve 288.

The pressurized sub-tank 220 includes a gas chamber 220*a* in which ink and gas coexist. The pressurized sub-tank 220 includes a liquid level detector 221 and a solenoid valve 222. The liquid level detector 221 detects a liquid level in the pressurized sub-tank 220. The solenoid valve 222 serves as a mechanism that opens the inside of the pressurized sub-tank 220 to the atmosphere. The pressurized sub-tank 220 is coupled to the supply port 171 of the head 100 through the circulation path 402.

The collection pressure sensor 233 is provided between the pressurized sub-tank 220 and the head 100. The collection pressure sensor 233 detects a pressure that the pressure generator 401 applies to the ink that circulates through the circulation path 402.

The depressurized sub-tank 210 is coupled to the discharge port 181 of the head 100 through the circulation path 402, the bubble sensor 405, and the deaerator 406.

[Variable Resistance 404]

Figure 8:
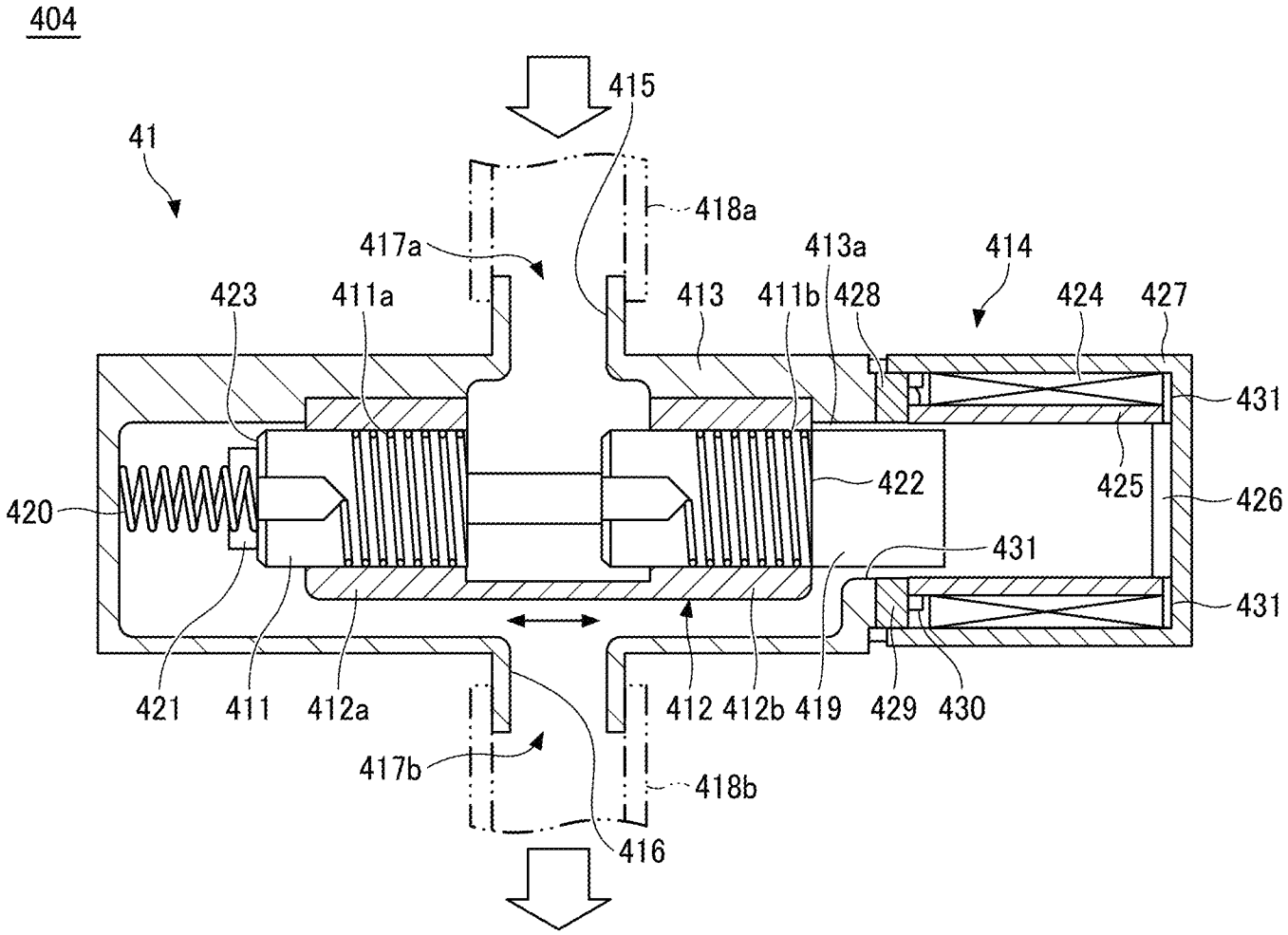
FIG. 8 is a diagram illustrating an example of the configuration of a variable resistance.

FIG. 8 is a diagram illustrating an example of the configuration of the variable resistance 404. FIG. 8 illustrates the configuration of the solenoid valve 41 included by the variable resistance 404 in particular.

As illustrated in FIG. 8, the solenoid valve 41 includes a piston 411, a cylinder member 412, a housing 413, and a solenoid 414.

The piston 411 has grooves 411*a* and 411*b* on the surface of the piston 411. The grooves 411*a* and 411*b* are paired. The grooves 411*a* and 411*b* of the piston 411 are inserted in the cylinder member 412. The housing 413 covers the piston 411 and the cylinder member 412. The solenoid 414 applies a driving force to the piston 411 to move the piston 411 in the cylinder member 412.

The cylinder member 412 includes cylinders 412*a* and 412*b*. The cylinders 412*a* and 412*b* are integrally formed in a pair. The cylinder member 412 is attached to the housing 413 with rivets or the like.

The housing 413 has at least two inflow and outflow openings 415 and 416. The inflow and outflow openings 415 and 416 are coupled to pipes 418*a* and 418*b*, respectively. Ink flows through the pipes 418*a* and 418*b*. The inflow and outflow openings 415 and 416 and the pipes 418*a* and 418*b* form first channels 417*a* and 417*b* through which ink that is an object of flow rate adjustment flows.

The cylinder member 412 includes the cylinders 412*a* and 412*b* that are paired and correspond to the grooves 411*a* and 411*b* that are paired. The inner surfaces of the cylinders 412*a* and 412*b*, and the groove 411*a* inserted in the cylinder 412*a*, and the groove 411*b* inserted in the cylinder 412*b* form a second channel.

The second channel branches in directions symmetrical with respect to the first channels 417*a* and 417*b*. The solenoid valve 41 allows a variable fluid resistance in the second channel to adjust the flow rate of the ink that flows through the first channels 417*a* and 417*b*.

Being formed in a pair means being formed in such a manner that a fluid resistance to ink that separately flows into each of paired portions is equal, and the ink that has flowed into each of the paired portions flows out in each of positive and negative direction of a relative movement of the piston 411 and the cylinder member 412.

Ink that has flowed into through the pipe 418*a* branches near the first channel 417*a* near the inflow and outflow opening 415, passes through the second channel, merges again near the first channel 417*b* near the inflow and outflow opening 416, and is made to flow out to the pipe 418*b*.

The pressure of the ink that has flowed into from the outside of the solenoid valve 41 is similarly decreased, and thus the ink is similarly expanded into a lower-pressure state in each of the paired channels, and the ink flows out to the inflow and outflow opening 416.

The solenoid valve 41 moves the piston 411 in the cylinders 412*a* and 412*b* to change the length of the second channel. Consequently, the solenoid valve 41 varies the fluid resistance in the second channel, and thus adjusts the amount of ink that flows through the second channel, and the flow rate of ink that flows through the solenoid valve 41.

When ink flows toward the second channel from the first channel 417*a*, the ink that flows into from the inflow and outflow opening 415 often has a high pressure. The fluid resistance at a time when the ink passes through the second channel formed by the grooves 411*a* and 411*b* and the cylinders 412*a* and 412*b* decreases the pressure of the ink to expand the ink into a lower-pressure fluid. Then the ink is made to flow out to the outside through the first channel 417*b*.

On one lengthwise end surface 422 of the piston 411, a plunger 419 is provided. The plunger 419 includes a magnetic body and substantially has a columnar shape. On the other lengthwise end surface 423 of the piston 411, a tension spring 420 is provided.

The plunger 419 can be easily inserted and removed into and from the housing 413 through a through hole 413*a* provided for the housing 413. Outside the through hole 413*a* of the housing 413, the solenoid 414 is provided. The plunger 419 and the piston 411 can be inserted in the solenoid 414.

The solenoid 414 includes a coil 424, a bobbin 425 around which the coil 424 is wound, a core 426, and yokes 427 and 428. The core 426 and the yokes 427 and 428 include magnetic bodies. The solenoid 414 attracts the plunger 419 that includes a magnetic body, by an attraction force generated according to an injected electric current. Consequently, the solenoid 414 moves the piston 411 toward the solenoid 414.

Between the yoke 427 and the housing 413, a seal 429 is formed by welding to prevent leakage of fluid from the inside of the solenoid valve 41. Between the bobbin 425 and the yoke 428, a joint 430 is formed, and between the core 426 and the yoke 427, a joint 431 is formed to prevent ink from leaking toward the coil 424.

The tension spring 420 provided on the other lengthwise end surface 423 of the piston 411 is secured to a wall of the housing 413. The tension spring 420 in a state of being extended a little to generate a tension is held in a state where a stopper 421 and the other end surface 423 of the piston 411 are pressed against each other.

The variable resistance 404 varies fluid resistance to the ink that passes through the solenoid valve 41, with the solenoid valve 41 provided in the bypass 403. Consequently, the variable resistance 404 switches between a state where ink flows through the bypass 403 and a state where ink does not flow through the bypass 403, to switch between the first path and the second path.

For example, the second path is in a state where the fluid resistance is large, and little ink passes through the solenoid valve 41. The first path is in a state where the fluid resistance is small, and ink passes through the solenoid valve 41.

In the first path, the amount of ink that passes through the solenoid valve 41 is appropriately set. As the amount of ink that passes through the solenoid valve 41 and flows through the bypass 403 increases, the ability to discharge a bubble in ink increases. Therefore, the liquid supply apparatus 200 may perform control with the controller 500 in such a manner that as a time period for which the bubble sensor 405 detects a bubble in the ink increases, the fluid resistance is gradually decreased to gradually increase the amount of ink that flows through the bypass 403.

[Controller 500]

Figure 9:
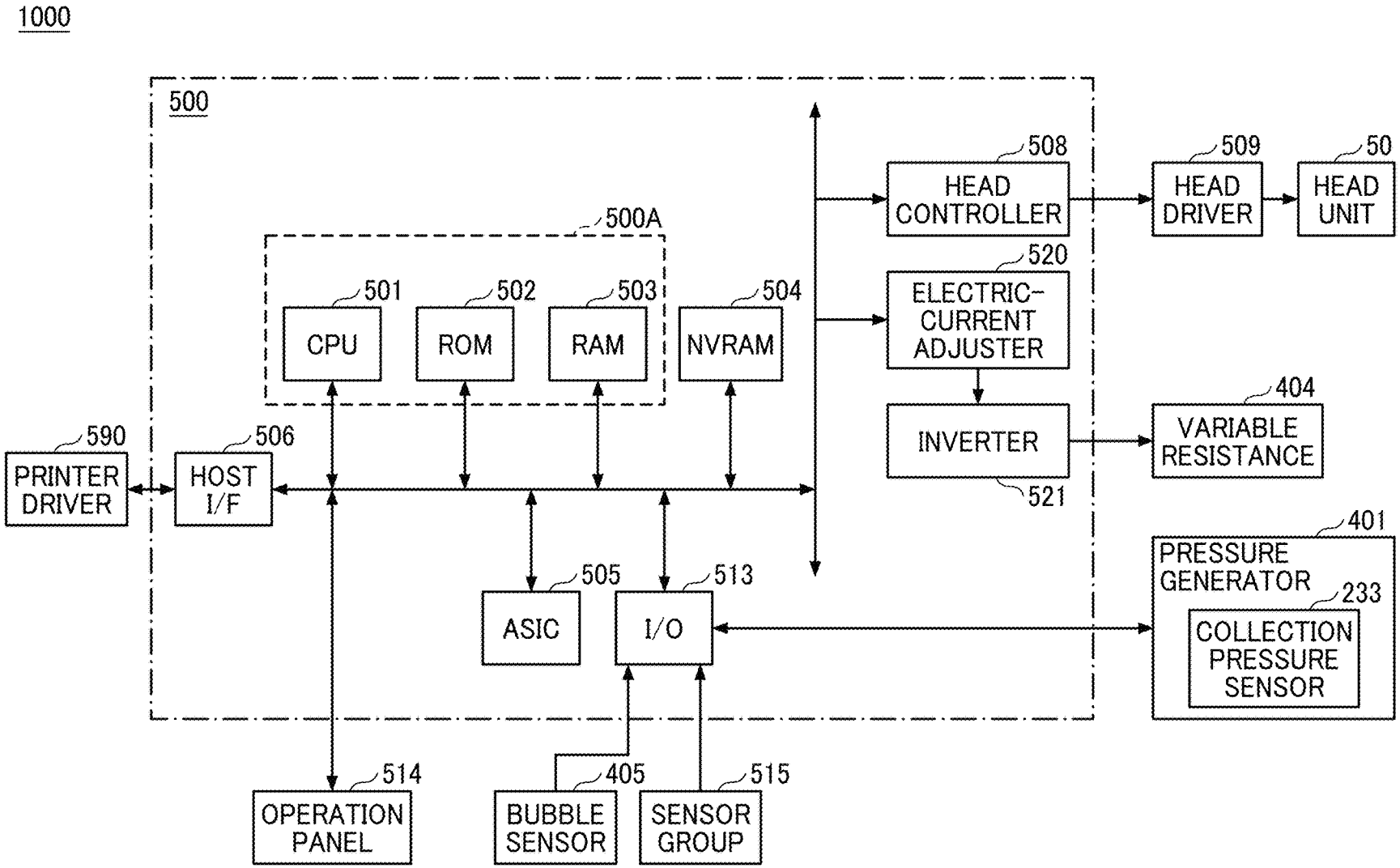
FIG. 9 is a block diagram of an example of the hardware configuration of a controller according to an embodiment.

FIG. 9 is a block diagram illustrating an example of the hardware configuration of the controller 500. As illustrated in FIG. 9, the controller 500 includes a main controller 500A, a non-volatile random access memory (NVRAM) 504, an application specific integrated circuit (ASIC) 505, and a host interface (I/F) 506. The controller 500 also includes a head controller 508, an electric-current adjuster 520, an inverter 521, and an input/output (I/O) 513. Although in FIG. 9, the main hardware configuration of the controller 500 is exemplified, the controller 500 may include components except the components illustrated in FIG. 9.

The main controller 500A includes a central processing unit (CPU) 501, a read only memory (ROM) 502, and a random access memory (RAM) 503.

The CPU 501 controls the entire image forming apparatus 1000. The ROM 502 is a non-volatile memory that stores fixed data, such as various programs that include programs executed by the CPU 501. The RAM 503 is a volatile memory that temporarily stores image data and the like, in addition to the ROM 502.

The NVRAM 504 is a rewritable memory to hold data even while the power supply to the image forming apparatus 1000 is shut off. The ASIC 505 performs image processing to image data, such as various signal processing and sorting, and processes input and output signals for other control. The host I/F 506 is an interface for communicating with a printer driver 590 provided for an external device, such as a host personal computer (PC).

The head controller 508 is an electric circuit that includes a data transmitter, a driving-signal generator, and a bias-voltage output device that are for controlling the driving of the heads 100 included by the head unit 50. The head controller 508 controls the ink discharge by the heads 100 through a head driver 509. The head driver 509 is a driving integrated circuit (IC) for driving the heads 100.

The I/O 513 is an interface that enables the controller 500 to communicate with external devices. The main controller 500A is electrically coupled to each of the bubble sensor 405, a sensor group 515, and the pressure generator 401 through the I/O 513 to transmit and receive detected data and control signals.

The electric-current adjuster 520 and the inverter 521 are components used to control the variable resistance 404. The main controller 500A transmits control signals to the variable resistance 404 through the electric-current adjuster 520 and the inverter 521.

The controller 500 is coupled to an operation panel 514. The operation panel 514 is for inputting and displaying information necessary for the image forming apparatus 1000.

Figure 10:
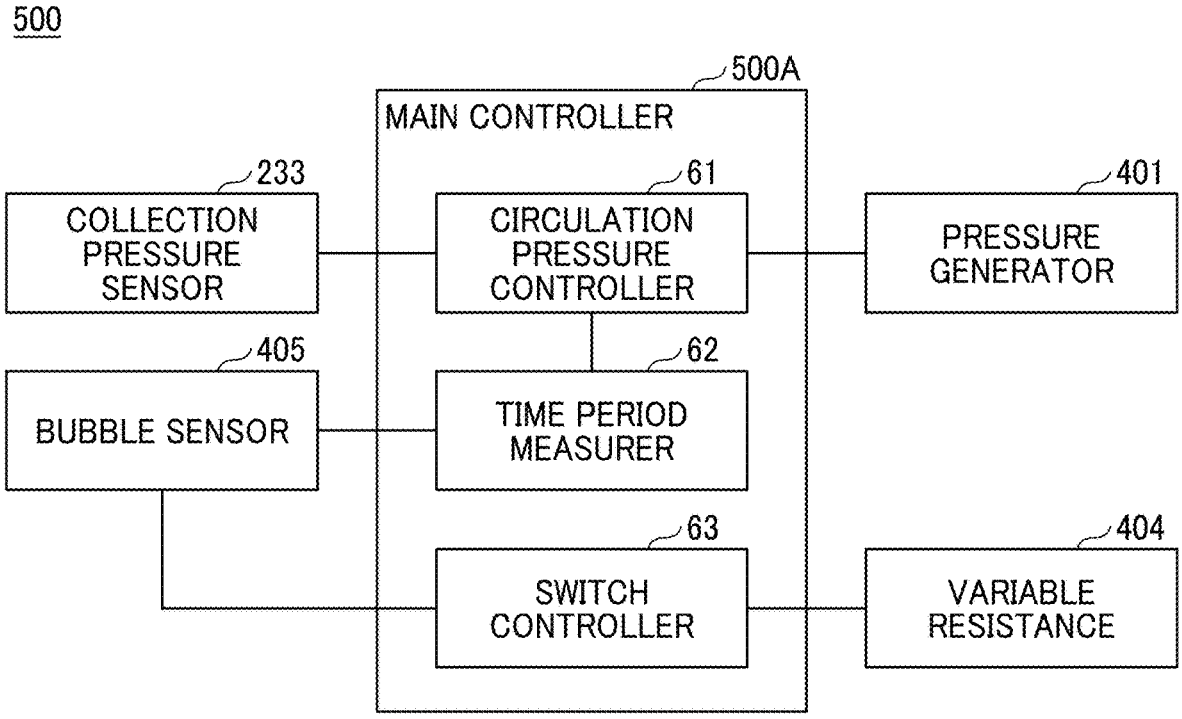
FIG. 10 is a block diagram of an example of the functional configuration of a main controller according to an embodiment.

FIG. 10 is a block diagram illustrating an example of the functional configuration of the main controller 500A included by the controller 500. As illustrated in FIG. 10, the main controller 500A includes a circulation pressure controller 61, a time period measurer 62, and a switch controller 63. The main controller 500A implements the functions by, for example, the CPU 501 in FIG. 9 executing programs stored in the ROM 502 and the like.

The circulation pressure controller 61 acquires results of detection of circulation pressures of the ink that circulates through the circulation path 402, from the collection pressure sensor 233 provided for the pressure generator 401. According to the results of detection, the circulation pressure controller 61 controls the generation of a circulation pressure generated by the pressure generator 401.

When a meniscus in the nozzle N that is an interface between ink and air outside the individual chamber 106 becomes abnormal, only circulating the ink through the bypass 403 may not fully discharge a bubble in the ink, and a time period for which the bubble is detected may last a long time.

Therefore, when a time period for which the bubble sensor 405 detects a bubble is equal to or longer than a predetermined time period threshold th, the circulation pressure controller 61 temporarily stops the generation of a circulation pressure generated by the pressure generator 401 to temporarily stop the circulation of the ink. When the circulation of the ink stops, a positive pressure and a negative pressure that act on the ink are in substantially the same states. Then the circulation pressure controller 61 restarts the generation of the circulation pressure generated by the pressure generator 401 to allow the positive pressure and the negative pressure that act on the ink to be in predetermined states to restart the circulation of the ink. Consequently, the abnormal meniscus is eliminated.

The time period measurer 62 measures a time period for which the bubble sensor 405 detects a bubble. For example, at the time when the time period measurer 62 receives a detection result that indicates the generation of a bubble, from the bubble sensor 405, the time period measurer 62 starts to count clocks of the CPU 501. Then the time period measurer 62 multiplies the number of counted clocks at every time at which a time period measurement result is necessary, by a time that corresponds to one clock to measure a time period for which the bubble sensor 405 detects the bubble.

The switch controller 63 controls the switch operation by the variable resistance 404 that alternately switches between the first path and the second path. More specifically, the switch controller 63 monitors results of detection of bubbles detected by the bubble sensor 405. When the bubble sensor 405 detects a bubble, the switch controller 63 performs control in such a manner that the fluid resistance in the variable resistance 404 is varied and increased to allow the ink to flow through the first path.

The switch controller 63 monitors results of detection of bubbles detected by the bubble sensor 405. When the bubble sensor 405 does not detect a bubble, the switch controller 63 performs control in such a manner that the fluid resistance in the variable resistance 404 is varied and decreased to allow the ink to flow through the second path. In other words, under the control by the switch controller 63, the variable resistance 404 varies the fluid resistance to the ink that flows through the bypass 403 to alternately switch between the first path and the second path.

Example of Operations of Liquid Supply Apparatus 200

Figure 11:
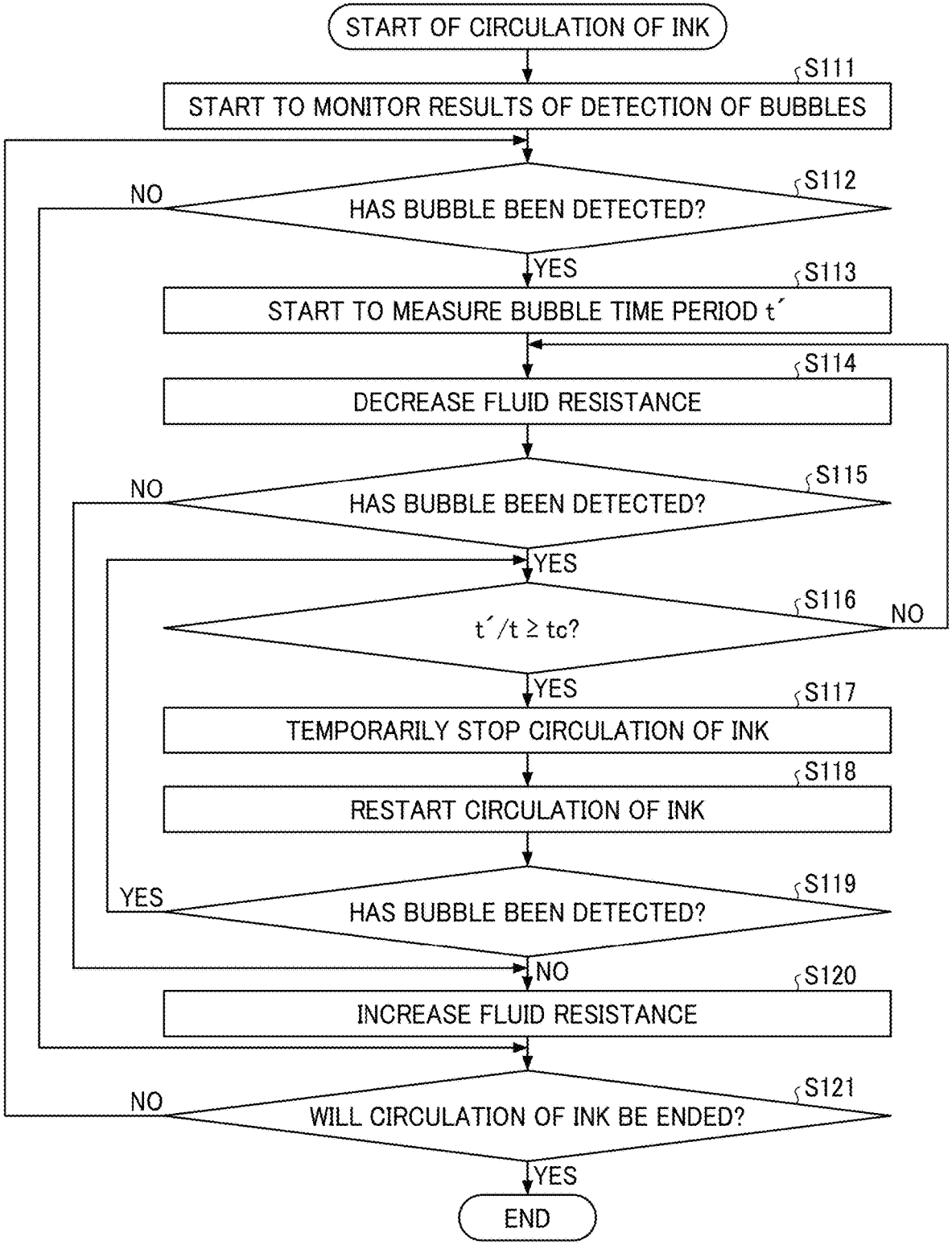
FIG. 11 is a flowchart illustrating an example of operations of the liquid supply apparatus according to an embodiment.

FIG. 11 is a flowchart illustrating an example of operations of the liquid supply apparatus 200 according to an embodiment of the present disclosure.

FIG. 11 illustrates operations of the liquid supply apparatus 200 triggered at a timing at which the liquid supply apparatus 200 starts to circulate the ink. The timing at which the liquid supply apparatus 200 starts to circulate the ink is, for example, a timing at which the image forming apparatus 1000 or the liquid supply apparatus 200 is activated.

After the ink starts to circulate, the ink continues to circulate until all the operations illustrated in FIG. 11 end unless the ink circulation is temporarily stopped. In the original state of the liquid supply apparatus 200, the path through which the ink circulates is the second path.

First, in step S111, the switch controller 63 starts to monitor results of detection of bubbles detected by the bubble sensor 405 at a timing substantially the same as the start of the circulation of the ink started by the liquid supply apparatus 200.

Next, in step S112, the switch controller 63 determines whether or not the bubble sensor 405 has detected a bubble.

When in step S112, it is determined that a bubble has not been detected (No in step S112), the operation of the liquid supply apparatus 200 shifts to step S121.

When in step S112, it is determined that a bubble has been detected (Yes in step S112), the time period measurer 62 starts to measure a bubble time period t' that is a time period for which the bubble sensor 405 detects the bubble, for example, starts to count clocks of the CPU 501, in step S113.

Next, in step S114, the switch controller 63 controls the variable resistance 404 to decrease the fluid resistance to the fluid that flows through the bypass 403. Consequently, a switch to the first path is performed, and the ink flows through the bypass 403. Consequently, the ability to discharge a bubble in ink is improved. The bubble in the ink is gradually removed by the deaerator 406 as the ink circulates. Although a timing at which step S114 is performed is appropriately set, the timing is, for example, substantially the same as the timing at which step S113 is performed.

Next, in step S115, the time period measurer 62 determines whether or not the bubble sensor 405 has detected a bubble.

When in step S115, it is determined that a bubble has not been detected (No in step S115), the operation of the liquid supply apparatus 200 shifts to step S120.

When in step S115, it is determined that a bubble has been detected (Yes in step S115), the time period measurer 62 determines whether or not t'/t≥tc is valid, in step S116. For example, the time period measurer 62 multiplies the number of counted clocks at the time, by a time that corresponds to one clock to acquire information about the bubble time period t', and determines whether or not t'/t≥tc is valid.

t is a predetermined time period. tc is a predetermined ratio threshold. The predetermined time period t multiplied by the predetermined ratio threshold tc corresponds to a time period threshold th. Therefore, in other words, in step S116, the time period measurer 62 determines whether or not the bubble time period t' is equal to or longer than the time period threshold th.

When in step S116, it is determined that t'/t≥tc is not valid (No in step S116), the liquid supply apparatus 200 performs the operations of step S114 and the subsequent steps again.

As the amount of ink that flows through the bypass 403 increases, the ability to discharge a bubble increases. However, since the circulation path 402 becomes long, the stability of supply of the ink to the heads 100 may decrease.

Therefore, as the bubble time period t' increases, the liquid supply apparatus 200 repeats the operations of steps S114 to S116 to gradually decrease the fluid resistance to gradually increase the amount of ink that flows through the bypass 403. Consequently, the stability of the supply of the ink is avoided decreasing. The stability of the supply of the ink decreases because the fluid resistance rapidly decreases, and thus the amount of the ink fed through the bypass 403 is equal to or larger than the amount necessary for improvement in the ability to discharge a bubble.

When in step S116, it is determined that t'/t≥tc is valid (Yes in step S116), the circulation pressure controller 61 temporarily stops the generation of the circulation pressure to temporarily stop the circulation of the ink through the circulation path 402 in step S117.

Next, in step S118, the circulation pressure controller 61 restarts the generation of the circulation pressure to allow the positive pressure and the negative pressure to be in predetermined states to restart the circulation of the ink.

Next, in step S119, the time period measurer 62 determines whether or not the bubble sensor 405 has detected a bubble.

When in step S119, it is determined that a bubble has been detected (Yes in step S119), the operation of the liquid supply apparatus 200 shifts to step S116. The liquid supply apparatus 200 repeats the operations of step S116 and the subsequent steps until the bubble is not detected.

When in step S119, it is determined that a bubble has not been detected (No in step S119), the switch controller 63 controls the variable resistance 404 to increase the fluid resistance to the fluid that flows through the bypass 403 in step S120. Consequently, a switch to the second path is performed, and the ink does not flow through the bypass 403.

Thus, the switch controller 63 (circuitry) controls the switch (variable resistance 404) to switch the circulation path to the second path in response to the bubble undetected by the detector (bubble sensor 405).

Next, in step S121, the liquid supply apparatus 200 determines whether or not the circulation of the ink will be ended. According to, for example, a user operating the image forming apparatus 1000 with the operation panel 514, the liquid supply apparatus 200 determines whether or not the circulation of the ink will be ended.

When in step S121, it is determined that the circulation of the ink will be ended (Yes in step S121), the liquid supply apparatus 200 ends the operation. When in step S121, it is determined that the circulation of the ink will not be ended (No in step S121), the liquid supply apparatus 200 performs the operations of step S112 and the subsequent steps again.

In this way, the liquid supply apparatus 200 switches between the first path and the second path when ink circulates through the circulation path 402. When a bubble is detected in the ink, the liquid supply apparatus 200 improves the ability to discharge a bubble.

[Operational Effects of Liquid Supply Apparatus 200]

As described above, the liquid supply apparatus 200 (liquid supply apparatus) according to the present embodiment supplies ink (liquid) to the heads 100 (liquid discharger). The liquid supply apparatus 200 includes the circulation path 402, the bypass 403, the pressure generator 401, the deaerator 406, the variable resistance 404 (switch), the bubble sensor 405 (detector), and the switch controller 63 (controller). When the bubble sensor 405 detects a bubble, the switch controller 63 performs control to allow the ink to flow through the first path.

For example, the configuration disclosed in Patent Literature 1 varies a pressure applied to ink to destroy a meniscus to remove a bubble in the ink. Therefore, a waiting time for which the destroyed meniscus returns to a state where the ink can be discharged is necessary. There is a fear that the bubble in the ink is not efficiently removed.

According to the present embodiment, however, when the bubble sensor 405 detects a bubble, the liquid supply apparatus 200 allows ink to flow through the bypass 403 to improve the ability to discharge a bubble, to remove the bubble in the ink during a process during which the ink is circulated. Since the liquid supply apparatus 200 does not vary the pressure applied to the ink, a waiting time for returning to a state where the ink can be discharged is not necessary. Consequently, the liquid supply apparatus 200 that efficiently removes a bubble in the ink is provided.

According to the present embodiment, when the bubble sensor 405 does not detect a bubble, the switch controller 63 performs control to allow ink to flow through the second path. Consequently, when no bubble is in the ink, the ink does not need to circulate through a path that includes the bypass 403. Therefore, the meniscus pressure difference in a nozzle N row that most affects the variations in the discharge characteristics between the nozzles N is decreased. Thus, the variations in the discharge characteristics between the nozzles N are reduced to stabilize the discharge. The meniscus pressure difference in a nozzle N row corresponds to, for example, the meniscus pressure difference in each of the nozzle N1 and the nozzle N640 in FIG. 6.

According to the present embodiment, the variable resistance 404 varies a fluid resistance that is a resistance to ink that flows through the bypass 403 to alternately switch between the first path and the second path. For example, the variable resistance 404 includes the solenoid valve 41, and the solenoid valve 41 varies a fluid resistance to ink that passes through the solenoid valve 41 to vary a fluid resistance to ink that flows through the bypass 403.

For example, when a solenoid valve or the like is used to switch the paths, the configuration of the liquid supply apparatus 200 may be complicated due to the control of the solenoid valve. However, since a fluid resistance is varied to switch the paths, complicated control is not necessary. Therefore, the liquid supply apparatus 200 alternately switches between the first path and the second path with a simpler configuration.

According to the present embodiment, when a time period for which the bubble sensor 405 detects a bubble is equal to or longer than a predetermined time period threshold th, the pressure generator 401 temporarily stops and then restarts the generation of a circulation pressure. Consequently, states of meniscuses in the head 100 are reset. Therefore, even when a meniscus is abnormal, and only feeding ink through the bypass 403 fully discharges a bubble in the ink with difficulty, the liquid supply apparatus 200 eliminates the abnormal meniscus to discharge the bubble.

According to the present embodiment, as a time period for which the bubble sensor 405 detects a bubble in the ink increases, the variable resistance 404 gradually decreases the fluid resistance to the ink fed through the bypass 403 to gradually increase the amount of the ink that flows through the bypass 403. Consequently, the amount of ink fed through the bypass 403 is avoided being equal to or larger than the amount necessary for improvement in the ability to discharge a bubble. Therefore, the liquid supply apparatus 200 provides both the stability of supply of the ink, and the ability to discharge a bubble.

Second Embodiment

Next, a liquid supply apparatus 200*a* according to a second embodiment will be described. The same components as the components of the first embodiment are denoted by the same reference numerals, and redundant description of the same components will be appropriately omitted.

The difference between the liquid supply apparatus 200*a* and the first embodiment is that the liquid supply apparatus 200*a* supplies ink to a head 100*a* that includes four nozzle rows. Except the difference, the liquid supply apparatus 200*a* is the same as the first embodiment.

Figure 12:
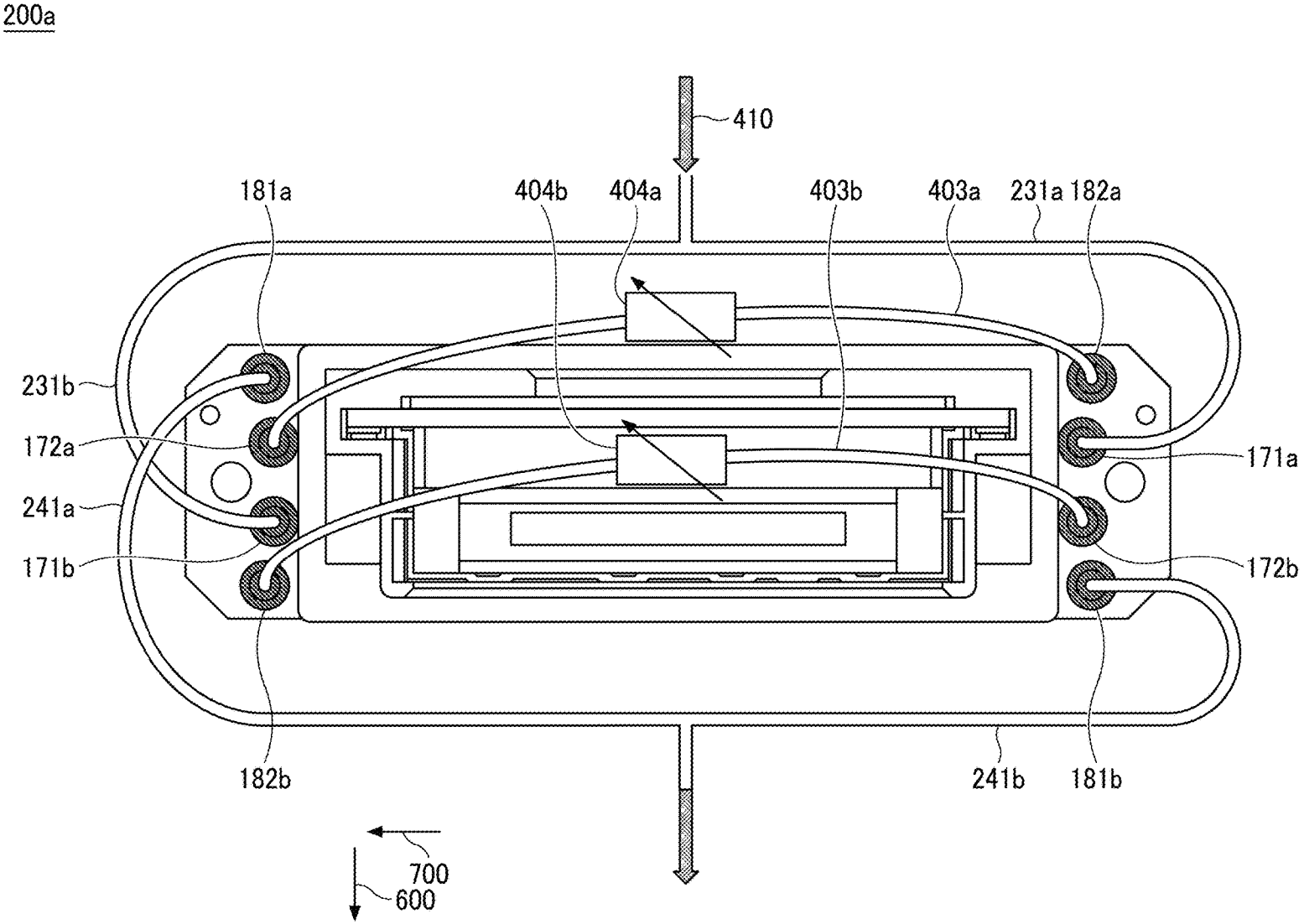
FIG. 12 is a diagram of an example of the configuration around a liquid discharge head according to a second embodiment of the present disclosure.

FIG. 12 is a diagram illustrating an example of the configuration around the head 100*a*.

Figure 13:
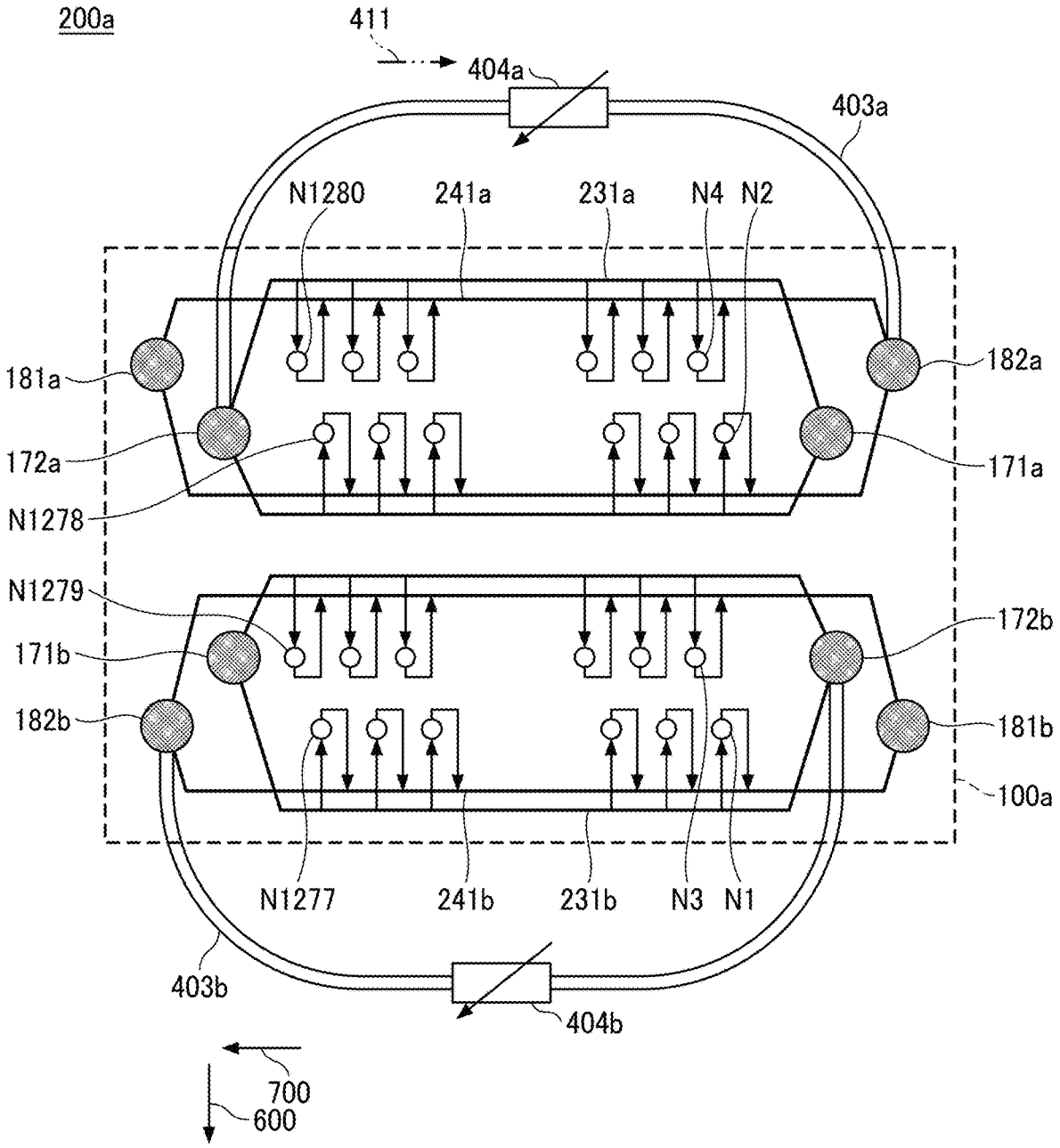
FIG. 13 is a diagram illustrating movement of ink in the liquid discharge head according to the second embodiment.

FIG. 13 is a diagram illustrating movement of ink in the head 100*a*.

FIGS. 12 and 13 are diagrams of the head 100*a* seen from the side where the nozzles are provided.

As illustrated in FIGS. 12 and 13, the head 100*a* includes supply paths 231*a* and 231*b*, discharge paths 241*a* and 241*b*, and supply ports 171*a* and 171*b*. The head 100*a* also includes bypass inlet ports 172*a* and 172*b*, discharge ports 181*a* and 181*b*, and bypass outlet ports 182*a* and 182*b*.

In other words, the head 100*a* includes two heads 100 according to the first embodiment arranged along a conveyance direction 600. The head 100*a* may be an element of the liquid supply apparatus 200*a* but is not an essential element of the liquid supply apparatus 200*a*.

The liquid supply apparatus 200*a* includes bypasses 403*a* and 403*b* and the variable resistances 404*a* and 404*b*. The bypass 403*a* and 403*b* are paths that couple the upstream side to the downstream side of the head 100*a* in a liquid circulation direction 410. The bypasses 403*a* and 403*b* include channels, such as ink tubes. The bypass inlet ports 172*a* and 172*b* are provided on the upstream side of the head 100*a* in the liquid circulation direction 410. The bypass outlet ports 182*a* and 182*b* are provided on the downstream side of the head 100*a* in the liquid circulation direction 410.

As illustrated in FIG. 13, the head 100*a* includes 1280 nozzles of nozzles N1 to N1280 arranged in four rows along a nozzle arrangement direction 700.

The nozzles N1 to N1280 are paired with 1280 individual chambers 106, respectively. Ink is supplied to the individual chambers 106 through the supply paths 231*a* and 231*b*. Consequently, each of the nozzles N is into a state of being able to discharge the ink. Each of the individual chambers 106 communicates with the discharge paths 241*a* and 241*b*. Ink supplied to the individual chambers 106 is discharged through the discharge paths 241*a* and 241*b*. In this way, the ink circulates while being repeatedly supplied and discharged to and from the individual chambers 106. Consequently, the ink is kept fresh in the individual chambers 106.

The path of ink that flows through each of the supply paths 231*a* and 231*b*, the discharge paths 241*a* and 241*b*, and the bypasses 403*a* and 403*b* is similar to the path of ink that flows through each of the supply path 231, the discharge path 241, and the bypass 403 in the first embodiment.

The liquid supply apparatus 200*a* supplies ink to such a head 100*a*, and acquires operational effects similar to the operational effects of the first embodiment. That is to say, according to the present disclosure, a liquid supply apparatus that efficiently removes a bubble in liquid is provided.

Although the present disclosure refers to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Although in the above-described embodiments, the liquid supply apparatus 200 that supplies ink to the image forming apparatus is exemplified, liquid supply apparatuses according to embodiments are not limited to the example.

A liquid supply apparatus according to an embodiment may supply liquid to a liquid discharge apparatus except an image forming apparatus, or may supply liquid to an object except the liquid discharge apparatus as long as the liquid supply apparatus includes a liquid discharger.

The numbers, such as ordinal numbers and numerical values that indicate quantities, are all given by way of example to describe the technologies to implement the embodiments of the present disclosure, and no limitation is indicated to the numbers given in the above description.

In addition, the description as to how the elements are related to each other, coupled to each other, or connected to each other is given by way of example to describe the technologies to implement the embodiments of the present disclosure, and how the elements are related to each other, coupled to each other, or connected to each other to implement the functionality in the present disclosure is not limited thereby.

Embodiments also include a liquid supply method. The liquid supply method is, for example, a liquid supply method with a liquid supply apparatus for supplying liquid to a liquid discharger.

The liquid supply apparatus includes: a circulation path through which the liquid circulates; a bypass coupling an upstream side to a downstream side, in a liquid circulation direction, of the liquid discharger provided in the circulation path; a pressure generator configured to generate a circulation pressure for circulating the liquid through the circulation path; a deaerator configured to remove gas in the liquid; and a switch configured to alternately switch between a first path that includes the bypass as part of the circulation path, and a second path that does not include the bypass in the circulation path.

The liquid supply method with the liquid supply apparatus includes detecting a bubble in the liquid fed through the circulation path; and controlling a switch operation by the switch. When the detecting detects the bubble, the controlling performs control to allow the liquid to flow through the first path.

Such a liquid supply method provides operational effects equivalent to those of the above-described liquid supply apparatuses.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions such as the controller 500, the switch controller 63 and the main controller 500A as described in the above embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

As described above, the liquid discharge apparatus (image forming apparatus 1000) includes the head 100 including the supply path and the discharge path circulating a liquid in a liquid circulation direction, the head 100 configured to discharge the liquid, a circulation path coupled to the head 100, the liquid circulates through the head 100 in the circulation path, the bypass 403 coupled to a downstream end of the supply path of the head 100 and an upstream end of the discharge path of the head 100 in the liquid circulation direction, the pressure generator 401 configured to generate and apply a circulation pressure to the liquid circulating through the circulation path, the deaerator 406 configured to remove gas in the liquid circulating the circulation path, the switch (variable resistance 404) configured to alternately switchable the circulation path between a first path and a second path, the first path including the bypass 403 as a part of the circulation path, and a second path not including the bypass 403 in the circulation path, the detector (bubble sensor 405) configured to detect a bubble in the liquid circulating through the circulation path, and circuitry (switch controller 63) configured to control the switch (variable resistance 404) to switch the circulation path to the first path in response to a detection of the bubble by the detector (bubble sensor 405).

In the liquid discharge apparatus (image forming apparatus 1000), the circuitry (switch controller 63) controls the switch (variable resistance 404) to switch the circulation path to the second path in response to the bubble undetected by the detector (bubble sensor 405).

In the liquid discharge apparatus (image forming apparatus 1000), the switch includes a variable resistance 404 changeable a fluid resistance in the bypass 403, and the circuitry (switch controller 63) controls the variable resistance 404 to change the fluid resistance in the bypass 403 to alternately switch the circulation path between the first path and the second path.

In the liquid discharge apparatus (image forming apparatus 1000), the variable resistance 404 includes a solenoid valve, and a motor configured to drive the solenoid valve.

In the liquid discharge apparatus (image forming apparatus 1000), the circuitry (switch controller 63) controls the variable resistance 404 to decrease the fluid resistance in response to an increase in a time period of a detection of the bubble by the detector (bubble sensor 405).

In the liquid discharge apparatus (image forming apparatus 1000), the pressure generator 401 temporarily stops and then restarts generation of the circulation pressure in response to a time period of a detection of the bubble by the detector (bubble sensor 405) being equal to or longer than a predetermined time period threshold.

The invention claimed is:

1. A liquid discharge apparatus comprising:

a head including a supply path and a discharge path circulating a liquid in a liquid circulation direction, the head configured to discharge the liquid;

a circulation path coupled to the head, the liquid circulates through the head in the circulation path;

a bypass coupled to a downstream end of the supply path of the head and an upstream end of the discharge path of the head in the liquid circulation direction;

a pressure generator configured to generate and apply a circulation pressure to the liquid circulating through the circulation path;

a deaerator configured to remove gas in the liquid circulating the circulation path;

a switch configured to alternately switchable the circulation path between a first path and a second path, the first path including the bypass as a pan of the circulation path, and a second path not including the bypass in the circulation path;

a detector configured to detect a bubble in the liquid circulating through the circulation path; and circuitry configured to control the switch to switch the circulation path to the first path in response to a detection of the bubble by the detector.

2. The liquid discharge apparatus according to claim 1, wherein the circuitry controls the switch to switch the circulation path to the second path in response to the bubble undetected by the detector.

3. The liquid discharge apparatus according to claim 1, wherein the switch includes a variable resistance changeable a fluid resistance in the bypass, and the circuitry controls the variable resistance to change the fluid resistance in the bypass to alternately switch the circulation path between the first path and the second path.

4. The liquid discharge apparatus according to claim 3, wherein the variable resistance includes:

a solenoid valve, and a motor configured to drive the solenoid valve.

5. The liquid discharge apparatus according to claim 3, wherein the circuitry controls the variable resistance to decrease the fluid resistance in response to an increase in a time period of a detection of the bubble by the detector.

6. The liquid discharge apparatus according to claim 1, wherein the pressure generator temporarily stops and then restarts generation of the circulation pressure in response to a time period of a detection of the bubble by the detector being equal to or longer than a predetermined time period threshold.

7. A liquid discharge method comprising:

discharging a liquid from a head;

circulating the liquid through the head in a circulation path in a liquid circulation direction;

coupling a bypass to a downstream end of a supply path of the head and an upstream end of a discharge path of the head in the liquid circulation direction;

generating and applying a circulation pressure to the liquid circulating through the circulation path;

removing gas in the liquid circulating the circulation path;

alternately switching the circulation path between a first path and a second path, the first path including the bypass as a part of the circulation path, and a second path not including the bypass in the circulation path;

detecting a bubble in the liquid circulating through the circulation path; and switching the circulation path to the first path in response to a detection of the bubble by the detecting.

* * * * *